US012715675B2

(12) United States Patent
Ayrle et al.

(10) Patent No.: US 12,715,675 B2
(45) Date of Patent: Aug. 25, 2026

(54) CARTRIDGE FOR A DISPENSING DEVICE

(71) Applicant: Hilti Aktiengesellschaft, Schaan (LI)

(72) Inventors: Thomas Ayrle, Langerringen (DE); Ralf Willner, Tussenhausen (DE); Nicolas Ulrich, Augsburg (DE); Tobias Donner, Hohenpeissenberg (DE)

(73) Assignee: Hilti Aktiengesellschaft, Schaan (LI)

( * ) Notice: Subject to any disclaimer, the term of this patent is extended or adjusted under 35 U.S.C. 154(b) by 147 days.

(21) Appl. No.: 18/712,756

(22) PCT Filed: Nov. 16, 2022

(86) PCT No.: PCT/EP2022/082080
§ 371 (c)(1),
(2) Date: May 23, 2024

(87) PCT Pub. No.: WO2023/099211
PCT Pub. Date: Jun. 8, 2023

(65) Prior Publication Data

US 2025/0019143 A1 Jan. 16, 2025

(30) Foreign Application Priority Data

Nov. 30, 2021 (EP) ..... 21211200

(51) Int. Cl.
*B65D 81/32* (2006.01)
*B65D 83/00* (2006.01)

(52) U.S. Cl.
CPC ..... *B65D 81/3288* (2013.01); *B65D 83/771* (2025.01)

(58) Field of Classification Search
CPC ..... B65D 81/3288; B65D 83/771; B65D 83/7713; B05C 17/00583; B05C 17/00553
See application file for complete search history.

(56) References Cited

U.S. PATENT DOCUMENTS 4,989,758 A * 2/1991 Keller ..... B05C 17/00506 222/137
5,332,122 A * 7/1994 Herold ..... B65D 81/325 222/326

(Continued)

FOREIGN PATENT DOCUMENTS

CN 107107093 A 8/2017
DE 102 50 715 6/2003

(Continued)

OTHER PUBLICATIONS

International Search Report dated Jan. 5, 2023, in PCT/EP2022/082080, with English translation, 5 pages.

(Continued)

*Primary Examiner* — Paul R Durand
*Assistant Examiner* — Randall A Gruby
(74) *Attorney, Agent, or Firm* — Grüneberg Global IP, PLLC

(57) ABSTRACT

A cartridge for a dispenser, has at least one non-inherently rigid elongate film pouch and has a chamber for receiving a material, having a head part interacting with the film pouch and having an inherently rigid insert connected to the film pouch facing the head part, wherein the insert is arranged radially within the head part at least in regions. The insert and the head part are connected in a form-fitting and/or force-fitting manner. An outwards facing surface of the insert interacts in regions radially (R) with an inward facing surface of the head unit in a connection region transversely to a longitudinal direction (L) of the insert. The surface of the insert and of the head part have, in the connection region, a larger diameter in a region facing away from the head part than in a region facing the head part in the longitudinal direction (L), respectively.

18 Claims, 3 Drawing Sheets

(56) References Cited

U.S. PATENT DOCUMENTS 5,501,368 A * 3/1996 Brandhorst ..... B05C 17/01 222/326
5,647,510 A * 7/1997 Keller ..... B05C 17/00513 222/105
5,667,102 A * 9/1997 Keller ..... B05C 17/00513 222/327
5,697,524 A * 12/1997 Sedlmeier ..... B01F 33/5011 222/326
5,699,935 A * 12/1997 Stahley ..... B65D 81/325 222/326
5,873,492 A * 2/1999 Sullivan ..... B05C 17/0052 222/105
5,873,970 A * 2/1999 Konuma ..... B05C 17/00506 156/197
6,012,610 A * 1/2000 Pauser ..... B67B 7/28 141/330
6,158,621 A * 12/2000 Keller ..... B65D 83/7713 222/137
6,206,244 B1 * 3/2001 Muhlbauer ..... B05C 17/00576 222/105
6,299,022 B1 * 10/2001 Bublewitz ..... B05C 17/00586 222/326
6,352,177 B1 * 3/2002 Bublewitz ..... B01F 27/0724 222/137
6,644,509 B1 * 11/2003 Bublewitz ..... B05C 17/00583 222/88
6,796,460 B2 * 9/2004 Ichikawa ..... B65D 83/76 222/391
8,313,006 B2 * 11/2012 Willner ..... B05C 17/00559 222/326
8,690,012 B2 * 4/2014 Stoeckli ..... B05C 17/00503 222/145.5
9,217,342 B2 * 12/2015 Eisenbacher ..... F01M 11/0458
10,518,956 B2 * 12/2019 Wolf ..... B05C 17/00583
10,562,064 B2 2/2020 Lavelanet et al.
11,518,603 B2 * 12/2022 Seiler ..... B65D 35/12
12,377,436 B2 * 8/2025 Ayrle ..... B65D 83/771
2008/0127616 A1 * 6/2008 Matsumura ..... B65D 35/12 493/108
2014/0203023 A1 * 7/2014 Ettlin ..... B65D 25/20 220/601
2015/0114986 A1 * 4/2015 Ngu ..... B05C 17/00583 222/137
2018/0229260 A1 8/2018 Lavelanet et al.
2019/0022694 A1 * 1/2019 Dean ..... B05C 17/00513
2022/0379340 A1 12/2022 Ayrle et al.
2022/0396412 A1 12/2022 Donner et al.

FOREIGN PATENT DOCUMENTS

EP 3 834 951 6/2021
EP 3 835 232 6/2021

OTHER PUBLICATIONS

Written Opinion dated Jan. 5, 2023, in PCT/EP2022/082080, with English translation, 7 pages.

* cited by examiner

CARTRIDGE FOR A DISPENSING DEVICE

CROSS-REFERENCE TO RELATED APPLICATIONS

This application is a National Stage entry under § 371 of International Application No. PCT/EP2022/082080, filed on Nov. 16, 2022, and which claims the benefit of priority to European Application No. 21211200.7, filed on Nov. 30, 2021. The content of each of these applications is hereby incorporated by reference in its entirety.

BACKGROUND OF THE INVENTION

Field of the Invention

The present invention relates to a cartridge for a dispensing device.

Description of Related Art

Cartridges are primarily used for storing material such as glue, sealing compound, mortar, paint or lubricants. In addition, the material can easily be applied to an object via the cartridges, provided the cartridge is inserted into a corresponding dispensing device. The material can be applied precisely using the dispensing device. For example, a rod of the dispensing device presses against a base of the cartridge, as a result of which the volume of the cartridge is compressed, such that the material located in the cartridge is pressed out of an opening. An attachment can be attached to the cartridge so that the material can be applied to the object in a controlled and precise manner.

Cartridges are known which have an inherently non-rigid film pouch which is connected at one end to an inherently rigid insert. The inherently rigid insert can in turn be brought into operative connection with a head part to which, for example, a static mixer can be attached. The insert is for example attached to the head part by means of an adhesive connection.

EP 3 834 951 A1 discloses a cartridge with an inherently rigid insert which can be arranged on a head part by means of a latching device. In this design, a sealing effect between the head part and the insert may not be strong enough or may call for additional measures.

The object of the invention is to provide a cartridge in which an improved sealing between the insert and the head part can be achieved simply and inexpensively.

SUMMARY OF THE INVENTION

This object is achieved by the description herein. Further embodiments are specified in the description herein.

A cartridge for a dispensing device is proposed, having at least one non-inherently rigid elongate film pouch having a chamber for receiving material, having a head part for interacting with the film pouch and having an inherently rigid insert which is connected to the film pouch on a side facing the head part, wherein the insert is arranged at least in regions radially inside the head part and a connecting device is provided, by means of which the insert can be connected to the head part in a form-fitting and/or force-fitting manner, wherein the insert comprises at least one first connecting element of the connecting device and the head part comprises at least one second connecting element, and wherein the insert in a connecting region of the head part by means of a first surface which at least in regions faces radially outwards interacts with a surface of the head part which at least in regions faces radially inwards.

According to the invention, it is proposed that the first surface of the insert and the second surface of the head part have, in the connection region, a larger diameter in a region facing away from the head part in the longitudinal direction than in a region facing the head part in the longitudinal direction.

A cartridge designed according to the invention has the advantage that a particularly good seal between the head part and the film pouch or the insert is achieved in a structurally simple and also inexpensive manner. Due to the fact that the first surface of the insert and the second surface of the head part have, in the connection region, a larger diameter in a region facing away from the head part in the longitudinal direction than in a region facing the head part in the longitudinal direction, a good and secure contact between the insert and the head part with a correspondingly good seal, in particular during an application of pressure on the film pouch acting in the direction of the head part during a dispensing operation and a displacement caused thereby of the insert in the direction of the head part, is achieved by means of induced forces which act radially outwardly.

Furthermore, when the pressure is applied to the film pouch by a piston of a dispensing device, said pressure acting in the longitudinal direction in the direction of the head part, the insert is pressed more strongly against the head part with an improved sealing effect.

A particularly good seal is achieved when, in the connection region, a diameter not only of the head part but also of the insert steadily increases in the direction of a second end region facing the head part in the longitudinal direction after starting from a first end region facing away from the head part in the longitudinal direction. Here a diameter profile in the longitudinal direction can be selected flexibly.

A securing of the insert relative to the head part in the longitudinal direction is preferably achieved by means of the connecting device in such a way that, over the first surface of the insert and the second surface of the head part, sufficiently strong forces for sealing between the insert and the head part are present even in an unloaded state.

The first surface of the insert and the second surface of the head part lie, in particular in regions, preferably almost completely within the connection region in the unloaded state of the film pouch and thus are in contact with each other in particular fully circumferentially. By interaction of the insert with the head part over as large an area as possible, a sealing effect is advantageously strong.

In an advantageous embodiment of a cartridge according to the invention, the insert and the head part are substantially complementary to each other in the connecting region. As a result, a large-area interaction of the insert with the head part with an associated good sealing effect can be simply achieved.

Particularly preferably, the insert in the connection region is conical, wherein, in the connection region, an angle of 1° to 15°, preferably between 2° and 10°, is in each case present between the first surface of the insert and the second surface of the head part in the cross-section and the longitudinal direction L. The angle is preferably identical for the insert and the head part, so that the insert can interact with the head part over as large an area as possible.

It can be provided that the insert has a convex shape in the connection region. In this case, the head part is preferably concave on the inside radially, wherein the shape of the head part is preferably substantially complementary to the shape of the insert. It can also be provided that, in the connection region, the head part and/or the insert are designed to be concave or convex or conical in regions. Depending on the specific shape of the head part and the insert, a sealing effect desired for the respective application can be achieved.

In an advantageous embodiment of a cartridge according to the invention, the connecting device is detachable. This makes it possible to exchange faulty components in a simple manner, for example. Furthermore, a detachable connecting device, by means of a corresponding design of the connecting device, can be used to ensure that the connecting device is released when a defined force is applied. In this way, for example, damage to the head part, the insert and/or the film pouch can be prevented and a detached film pouch can then be reconnected to the head part or to the connector by means of the insert.

In a simple embodiment of the invention, the connecting device is designed as a latching connection or a snap connection or the like. The first connecting element can here be designed, for example, as a latching element that can be brought into engagement with the second connecting element, designed as a counter-latching element, for example in the form of a recess, or vice versa. In this way a simple arrangement of the insert on the head part is achieved, it also being possible to fix a position of the insert in the longitudinal direction of the cartridge in relation to the head part in a particularly precise and defined manner. With a corresponding design of the latching connection or snap connection, the film pouch or the insert can be connected to the head part by means of moderate joining forces while securing the stronger holding forces desired.

It can be provided that the first connecting element of the connecting device has at least one latching lug, in particular a plurality of latching lugs, which interacts with at least one recess of the head part.

The connecting device can, for example, have a latching lug which extends completely around the circumference in the circumferential direction and which interacts with a corresponding counter-element of the connecting device. It can be provided that the first connecting element or the second connecting element is designed as a latching lug and the second connecting element or the first connecting element is designed as a counter-element, for example in the form of a groove, a channel, a recess or the like.

If a connecting element of the connecting device has a positioning element, a position of the insert relative to the head part can be fixed in a defined manner in the circumferential direction and in particular a rotation of the insert relative to the head part can be prevented in a simple manner. The positioning element can be designed, for example, as a ridge or the like. If a connecting element is designed, for example, as a latching lug that extends almost completely in the circumferential direction, the position of the insert relative to the head part in the circumferential direction will be fixable in a defined manner by the second connecting element, designed for example as a recess with a ridge arranged between ends of the recess in the circumferential direction. The positioning element interacts, for example, with at least one latching lug representing a counter-element.

In order, for example, to reliably prevent rotation of the insert relative to the head part, the insert can have a plurality of latching lugs which can be brought into engagement with one or more recesses of the head part. In this case, for example, several ridges are provided which particularly reliably prevent the insert from rotating relative to the head part.

If at least one latching lug has, transversely to the longitudinal direction, an oversize relative to the at least one second connecting element of the head part, a secure seal between the insert and the head part is achieved in a simple manner even in an unloaded state of the film pouch, i.e., when no pressure is being applied to the film pouch by a piston of a dispensing device. This also applies to an already opened film pouch in the unloaded state, since the interaction of the insert with the head part required for this is achieved by the oversize of the at least one latching lug.

It became apparent that an oversize in the region of the at least one latching lug of less than 1%, in particular in the region of approximately 0.6% of a diameter of the film pouch, is advantageous, in which case undesirably strong joining forces and a plastic widening of the head part can be reliably avoided and a desired good sealing effect nevertheless be achieved. In the case of a film pouch with a diameter of approximately 50 mm, the oversize is in particular less than or equal to 0.5 mm, preferably approximately 0.3 mm. By providing the oversize, it is possible in a simple manner to achieve a leak-tightness during storage of broached containers over a particularly long period, for example over weeks. A seal between the insert, in addition to in a loaded state, can thus be ensured in an unloaded state and thus over the entire pressure spectrum occurring during operation.

In an advantageous embodiment of the invention, it is provided that a region of the head part, facing in the longitudinal direction a base region of the film pouch and having the second connecting element, has a distance from a shoulder of the insert in the longitudinal direction in an unloaded base position, so that a movement of the insert in relation to the head part, in particular when force is being applied to the film pouch by a piston of the dispensing device, is made possible in the longitudinal direction. As a result of this possibility of movement in the longitudinal direction provided in a structurally simple manner, a stronger sealing effect is achievable when an external force applied via the film pouch is increased during a dispensing process.

A conical design of the insert and of the head part with an angle, for example, greater than 5°, enables a smaller displacement of the insert with correspondingly weaker sealing forces relative to the head part than in the case of a conical design of the insert and of the head part with a small angle of, for example, less than 5°. It appears that a maximum displacement of the insert relative to the head part when an external force is applied to the film pouch should be less than 2 mm, in particular less than 1 mm, since a large displacement movement can cause undesired pumping effects. Moreover, high forces generated by small angles and large displacement movements of the insert relative to the head part may possibly lead to damage or failure of the insert or head part, which is in particular designed with plastic.

In order to close the film pouch in a simple manner and to prevent in a simple manner leakage from the material located in a chamber of the film pouch, the insert can have a passage closed by a cover. The cover enables a simple and safe and, in particular, defined opening in order to be able to dispense the material located in the chamber.

The film pouch can preferably be formed by a cylindrical film tube which is closed at the bottom by a base part, the base part being in particular glued and/or welded to the film tube. The film tube, also called tubular film or blown film, can be made of a thermoplastic material, and the film tube can be extruded or welded or glued at its longitudinal seam.

Since the base part is in particular glued and/or welded, this produces an integral bond, which improves the storage properties of the cartridge, such that a leakage rate of the cartridge is reduced compared to a cartridge in which a film pouch is closed by a clip closure.

In an advantageous design of the cartridge according to the invention, the head part is designed for connecting at least two inserts. Correspondingly, two, in particular inherently non-rigid, film pouches can be connected to the head part, and the film pouches in particular can have different materials. The head part is preferably designed such that the different materials can be guided separately from one another in the region of the head part up to the outlet opening, such that the different materials can come into contact only after the outlet opening. This is important in the case of two-component adhesives, for example.

The cartridge can thus receive different materials and serve as a multi-component packaging. In this case, it is possible that the outlet openings associated with the individual film pouches have diameters that differ from one another, such that a desired mixing ratio of the different materials can be set in a simple manner.

The materials located in the cartridge can be a chemical or a liquid, for example components of a two-component mixture.

Sealing compounds, multi-component mortars, multi-component coating compounds, multi-component paints, multi-component foam precursors, multi-component adhesives, multi-component sealing compounds and multi-component lubricants can be stored in the corresponding cartridges. It is possible for a resin, for example an epoxy resin, to be stored in one chamber and a curing agent for a two-component adhesive to be stored in the other chamber. The film pouches can have a comparable length, in which case a ratio of the bases of the film pouches determines a mixing ratio to be achieved. As an alternative to this, it is also possible for two film pouches to be used which have different lengths.

The receptacle of the head part can be assigned an expansion space into which the cover can expand. The expansion space makes it possible to open the cover in a controlled manner, so that it does not hinder the flow of the outflowing material. On the one hand, this results in a laminar flow, since there are no obstacles in the flow path that could result in a turbulent flow. On the other hand, this ensures that the flow rate is precisely maintained, which is important for the mixing ratio of two or more components.

An "inherently rigid component" is understood to mean a component that retains its shape if it is removed from a device. Such a component is also referred to as inherently stable.

The head part in particular represents a type of adapter, since the head part allows commercially available attachments or standardized dispensing devices to be used to apply the material located in the cartridge.

In an embodiment, the head part has an outlet nozzle that is in fluidic connection with the receptacle. The outlet nozzle can define the flow rate, in particular via its diameter.

It is possible that the outlet nozzle has a thread. Commercially available attachments or dispensing devices for applying the materials located in the cartridge can be attached by means of the thread to the head part precisely at an outlet opening of the outlet nozzle, thus making it possible to precisely position and meter the material during application.

The outlet nozzle can also have a partition which divides the volume into two or more outlet channels. The relative position of the partition in the outlet nozzle defines the cross-sections of the outlet channels and thus the flow rates through these outlet channels.

The outlet channels can have different diameters. The outlet channels can be oriented coaxially with respect to one another.

In one embodiment, the passage is tapered. As a result, the passage acts like a confuser or a nozzle when the composition flows out. The tapered passage can also act as a diffuser when the film pouch is being filled.

The film pouch can preferably be evenly collapsed in the longitudinal direction during a dispensing process, like an accordion, so that all of the material in the chamber can be used as far as possible. When in use, the film pouch is exposed to chemical materials or liquids which can sometimes attack the film pouch. An exact structure of the film pouch must therefore sometimes be adapted to the material in the chamber or to the liquid in the chamber, in particular to the corresponding material properties.

Further advantages can be found in the following description of the drawings. An exemplary embodiment of the present invention is shown in the drawings. The drawings and the description herein contain numerous features in combination. A person skilled in the art will expediently also consider the features individually and combine them to form further meaningful combinations.

BRIEF DESCRIPTION OF THE DRAWINGS

In the figures, identical and equivalent components are provided with the same reference signs. In the figures.

DETAILED DESCRIPTION OF THE INVENTION

Figure 1:
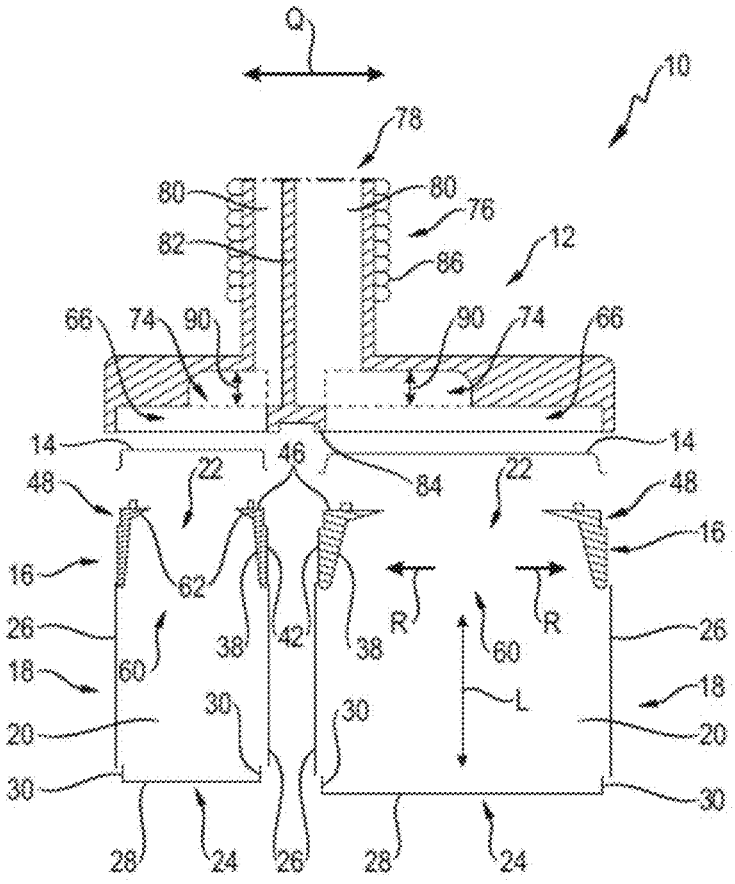
FIG. 1 is a longitudinal section through a cartridge according to the invention in an exploded view.

FIG. 1 is an exploded view of a cartridge 10 in a longitudinal section.

The cartridge 10 comprises a head part 12, two covers 14, two inserts 16 and two film pouches 18.

The film pouches 18 are inherently non-rigid and each have a cylindrical and substantially elongate shape. The film pouches 18 each delimit a chamber 20, wherein the insert 16 defines an opening 22. The chamber 20 is in particular sealingly closable by the film pouch, the insert 16 and the cover 14. The two film pouches 18 differ, like the inserts 16 and the covers 14, in terms of their dimensioning or their diameter, but are comparable as regards their structure. For example, cross-sections of the film pouches 18 have a cross-sectional area ratio of 1:3 or 1:5, wherein the cross-sectional area ratio of the film pouches 18 can in principle be selected as desired. In addition, the film pouches 18 have a substantially comparable length in the longitudinal direction L.

In the embodiment shown, the film pouch 18 is formed by a base part 24 and a film tube 26. The base part 24 has a base 28 and a collar 30 extending around the base 28. The film tube 26 is attached on the outside of the collar 30 by welding or gluing. In principle, the film tube 26 can also be attached to the inside of the collar 30 by welding or gluing.

The film tube 26 can be produced, for example, from a film by gluing or welding edge regions. It is also possible for a prefabricated film tube or a prefabricated film pouch to be used.

The base 28 is, for example, circular, such that the chamber 20 is cylindrical. In principle, however, any shape of the base 28 is conceivable, for example rectangular or polygonal.

The insert 16 is inherently rigid and internally at least partially inserted through the opening 22 into the corresponding chamber 20 of an associated film pouch 18, wherein the film tube 26 can be connected to the insert 16 externally in particular via a welding method. The cover 14 is preferably likewise connected to the insert 16 via a welding method.

The insert 16, which can be seen in more detail in FIG. 2 to FIG. 5, has a curved profile on an inner face 38 facing the chamber 20 so that the chamber 20 tapers toward the head part 12.

On a side facing the head part 12 in the longitudinal direction L, the insert 16 has a surface 46 at which the cover 14 is connected. The surface 46 is arranged obliquely in relation to a transverse direction running perpendicular to the longitudinal direction L, so that the insert 16 is conical in this region. The surface 46 facing the head part 12 forms an angle of, for example, approximately 15°-35° to the horizontal H.

The inner face 38 of the insert 16 facing the chamber 20 encloses a passage 60 which tapers in the direction of the head part 12.

In principle, the insert 16 is annular, so that it can be coupled to the cylindrical film tube 26.

The inner face of the film tube 26 is connected to the insert 16, the film tube 26 being connected to an outer face 42 of the insert 16 in the horizontal direction H. The film tube 26 is preferably welded or glued to the insert 16.

The cover 14 is provided between the head part 12 and the insert 16, as can be seen from FIG. 1. In the assembled state of the cartridge 10, the cover 14 rests in radially outer regions on the surface 46.

The cover 14 is connected to the insert 16, for example by welding or gluing, and closes the passage 60. Accordingly, the cover 14 closes the chamber 20, so that the chamber 20 is preferably completely sealed in the assembled state of the cover 14.

In the embodiment shown in FIG. 1, the head part 12 has two receptacles 66, in each case an insert 16 being connectable to a receptacle 66.

The receptacle 66 further comprises an expansion region 74 which is designed as a depression in the receptacle 66 and, as can be seen in FIG. 1, forms an expansion space 74 which has an expansion height 90.

The head part 12 also has an outlet nozzle 76 with an outlet opening 78 and an outlet channel 80. The outlet opening 78 is in fluidic connection with the expansion space 74 and the receptacle 66 via the outlet channel 80.

The outlet nozzle 76 shown in FIG. 1 has two outlet channels 80 which are in fluidic connection with the respective receptacle 66 and are separated from one another by a partition 82 which extends from a connecting piece 84 separating the receptacles 66 to the outlet opening 78.

It is possible for the two outlet channels 80, as shown in FIG. 1, to have different cross-sections, in particular different diameters, in order to set a desired mixing ratio of the materials in the individual film pouches.

The outlet nozzle 76 also has a thread 86 by means of which an attachment (not visible) can be attached to the outlet opening 78 of the head part 12.

A connecting device 200, which can be seen in FIG. 2 to FIG. 5, is provided for the form-fitting connection of the insert 16 to the head part 12. For this purpose, the insert 16 has at least one first connecting element 201 designed as a latching lug and the head part 12 has at least one second connecting element 202 designed as a counter-latching element. In the invention, the at least one second connecting element 202 is designed as a recess or groove in the head part 12 and is in particular designed to be complementary to the connecting element 201 designed as a latching lug, but can also be designed, for example, in the form of a uniform groove.

The insert 16 or the film pouch 18 can in the mounted state be secured on the head part 12 in a simple manner by means of the connecting device 200.

Figure 5:
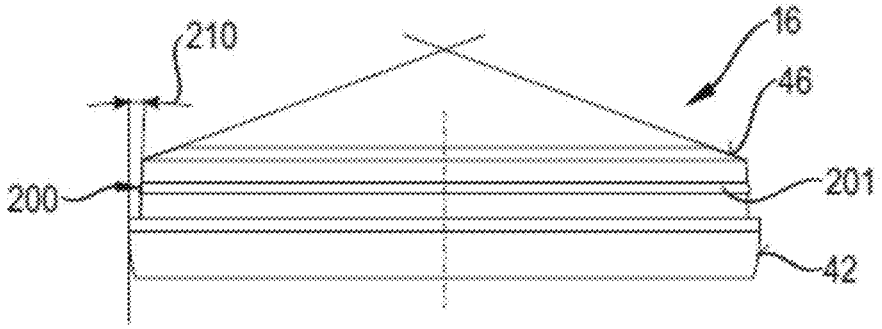
FIG. 5 is a simplified three-dimensional view of the insert of the cartridge according to FIG. 1 to FIG. 4 in isolation.

As can be seen in more detail in FIG. 5, for example, the insert 16 of the invention has a single connecting element 201 which extends completely all around in the circumferential direction and is designed to interact with a completely circumferential recess or groove 202 in the head part 12.

In an alternative embodiment to this, it can also be provided that the insert 16 has multiple connecting elements, for example six latching lugs, distributed in the circumferential direction, which interact in particular with a corresponding number of grooves or recesses in the head part. The positions of the connecting elements in relation to one another can be coordinated here and distributed uniformly or non-uniformly over the relevant circumference. A non-uniform distribution has the advantage that the connection of the insert 16 to the head part 12 is possible only in a defined position and thereby only one orientation is possible.

The connecting device 200 according to FIG. 5 is designed to be detachable, i.e., the latching lug 201 can be reversibly brought into engagement with the recess 202 of the head part 12. The latching lug 201 can be coordinated with the design of the head part 12 in the region of the recess 202 in such a way that the latching lug 201 releases from the recess 202 in the head part 12 when a force acting in the longitudinal direction L in a direction pointing away from the head part 12 exceeds a defined limit value. As a result, damage to the head part 12, the insert 16 and the film pouch 18 can be prevented and renewed attachment of the insert 16 to the film pouch 18 on the head part 12 can be achieved.

Figure 2:
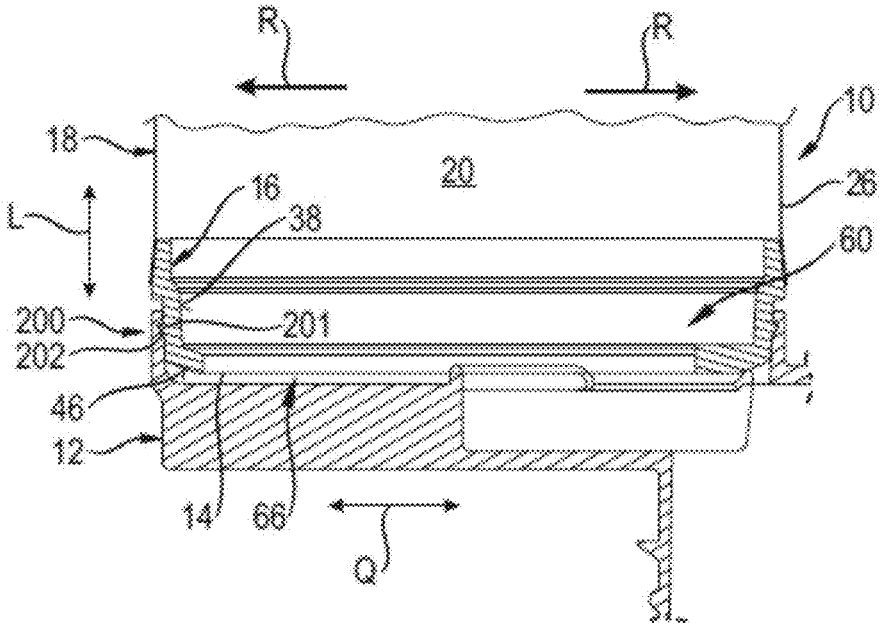
FIG. 2 is a simplified sectional view of a detail of the cartridge according to FIG. 1 in the assembled position, whereby a connecting device for connecting an insert to a head part can be seen in more detail.
Figure 3:
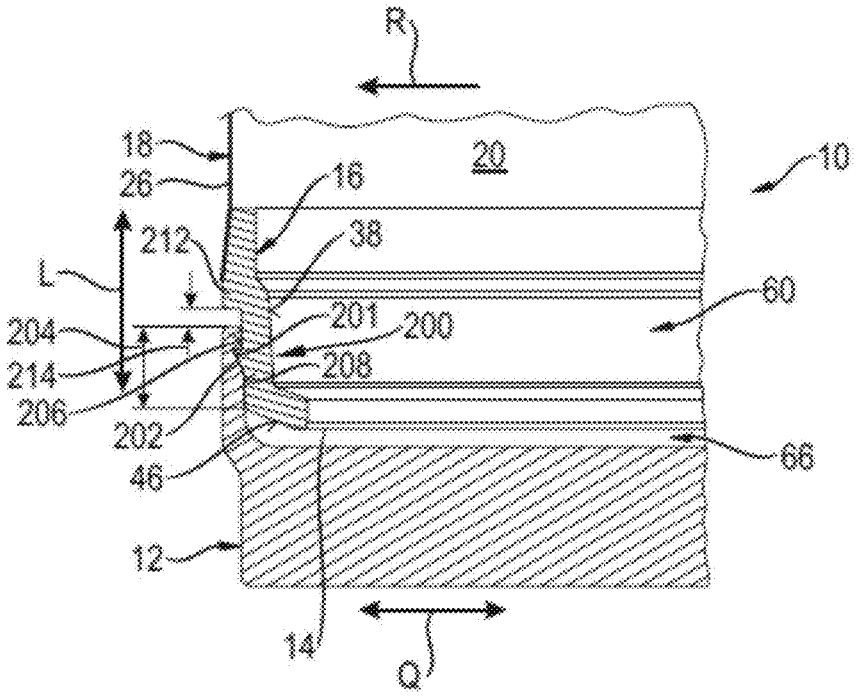
FIG. 3 is a simplified sectional view of the cartridge according to FIG. 1 and FIG. 2 in an unloaded state, wherein an interaction region of the insert with the head part can be seen in more detail.

In the unloaded state of the film pouch 18 according to FIG. 2 and FIG. 3, i.e., without an external force acting on the film pouch 18 from a piston of a dispensing device, in a connecting region 204 extending in the longitudinal direction L by means of a first surface 206, which faces outwards in the radial direction R at least in regions, the insert 16 interacts with a surface 208 of the head part 12 which faces inwards in the radial direction R at least in regions.

The insert 16 is conical in the region of the first surface 206, wherein the insert 16 has a larger diameter in a region facing the base part 24 than in a region facing the head part 12. Comparably, the head part 12 in the region of the receptacle 66 in the connection region 204 is radially on the inside, wherein the second surface 208 of the head part 12 has a larger diameter in the connection region 204 in a region facing the base part 24 than in a region facing the head part 12 in the longitudinal direction L. In the unloaded state of the film pouch 18, the insert 16 rests with the first face 206 in particular almost over the entire connection region 204 on the second face 208 of the head part 12.

In the invention, the insert 16 and the head part 12 are substantially complementary to one another in the connection region 204, so that a large interaction region of the insert 16 with the head part 12 is created.

Figure 4:
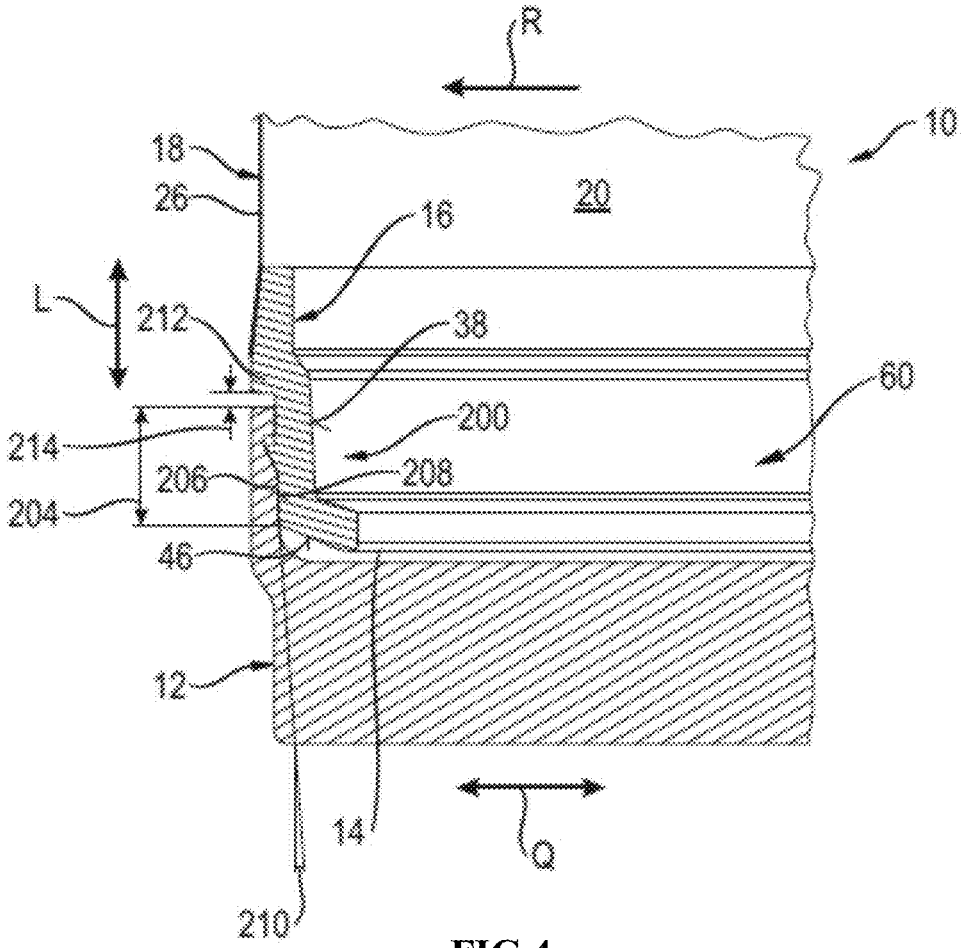
FIG. 4 shows a detail, corresponding to FIG. 3, of the cartridge according to FIG. 1 to FIG. 3, wherein a state in the case is shown of an external force being applied to the film pouch by a piston of a dispensing device.

In cross-section according to FIG. 2 to FIG. 4, the first surface 206 and the second surface 208 each have an angle 210 of 1° to 15°, in particular of 2° to 10°, particularly preferably of 3° to 5° relative to the longitudinal direction L.

Furthermore, transversely to the longitudinal direction L, the connecting element 201 designed here as a latching lug has an oversize relative to the connecting element 204 designed as a recess, which connection element is, for example, approximately 0.6% of a diameter of the film pouch 18. This means that a maximum diameter of the connecting element designed as a latching lug 201 when in the state not connected to the head part 12 has a diameter larger by 0.6% than a largest inner diameter of the head part 12 in the region of the connecting element 204 designed as a recess 204. As a result of this oversize, in the state when the insert 16 is connected to the head part 12, on the one hand a secure hold and, on the other hand, a desired pressing action is achieved even in the unloaded state of the film pouch 18, as a result of which a reliable seal is achieved between the insert 16 and the head part 12.

As shown in FIG. 2 and FIG. 3 in the unloaded state of the film pouch 18, a distance 214 is present in the longitudinal direction L between a lower end of the head part 12 in the region of the receptacle 66 and a shoulder 212, which distance allows a movement of the insert 16 relative to the head part 12.

If a force F acts on the film pouch 18 in the longitudinal direction L in the direction of the head part 12, for example during a dispensing process by a piston of a dispensing device, the insert 16 is displaced relative to the head part 12 in the longitudinal direction L in the direction of the head part 12 or in a direction facing away from the base part 24, as can be seen in more detail in FIG. 4. In this case, a pressing force increases between the insert 16 and the head part 12, so that a sealing effect between the insert 16 and the head part 12 is increased and the risk of a material located in the film pouch 18 escaping between the insert 16 and the head part 12 in the connecting region 204 is reduced.

In the case of a film pouch 18 having a diameter of approximately 50 mm, a preferred maximum displacement of the insert 16 relative to the head part 12 is in particular less than 2 mm, preferably approximately 1 mm.

In the embodiments shown, the cartridge 10 comprises one or two chambers 20 and a corresponding number of covers 14, inserts 16, film pouches 18, receptacles 66 and outlet channels 80. In general, a cartridge can in particular also have only one film pouch.

The invention claimed is:

1. A cartridge for a dispensing device, comprising:

at least one non-inherently rigid elongate film pouch defining a chamber for receiving a material;

a head part;

a cover; and at least one inherently rigid insert connected to the at least one non-inherently rigid elongate film pouch on a side of the at least one inherently rigid insert facing away from the chamber, wherein the at least one inherently rigid insert is arranged inside the head part and retained to the head part by a connecting device including at least one first connecting element on the at least one inherently rigid insert and at least one second connecting element on the head part, wherein the at least one inherently rigid insert and the head part define a connection region extending in a longitudinal direction of the cartridge, wherein, within the connection region, a side of the at least one inherently rigid insert facing the head part includes a first surface, and the head part includes a second surface facing the at least one inherently rigid insert, such that the first surface and the second surface are in contact, wherein the first surface and the second surface are conical, wherein the first surface and the second surface are angled relative to the longitudinal direction of the cartridge, wherein, along the longitudinal direction of the cartridge toward the at least one non-inherently rigid elongate film pouch, a first region of the connection region includes the first surface having a first respective diameter and the second surface having a second respective diameter, the first respective diameter and the second respective diameter having a first magnitude, and a second region of the connection region includes the first surface having a third respective diameter and the second surface having a fourth respective diameter, the third respective diameter and the fourth respective diameter having a second magnitude, wherein the first magnitude is greater than the second magnitude, and wherein a surface of the at least one inherently rigid insert is arranged obliquely relative to a transverse direction perpendicular to the longitudinal direction of the cartridge, and to which the cover is attached.

2. The cartridge according to claim 1, wherein the at least one inherently rigid insert and the head part have complementary shapes in the connection region such that the first surface and the second surface conform to one another.

3. The cartridge according to claim 1, wherein the first surface and the second surface are angled relative to the longitudinal direction of the cartridge by an angle of from 1° to 15° in cross-section in the connection region.

4. The cartridge according to claim 3, wherein the angle between the first surface and the second surface relative to the longitudinal direction of the cartridge is between 2° and 10°.

5. The cartridge according to claim 1, wherein the at least one inherently rigid insert has a convex shape in the connection region and the head part has a concave shape in the connection region.

6. The cartridge according to claim 1, wherein the connecting device is designed as a latching connection or a snap connection.

7. The cartridge according to claim 1, wherein the at least one first connecting element includes at least one latching lug, and wherein the at least one second connecting element includes at least one recess configured to interact with the at least one latching lug.

8. The cartridge according to claim 7, wherein the at least one latching lug includes a plurality of latching lugs configured to interact with the at least one recess.

9. The cartridge according to claim 1, wherein, transversely to the longitudinal direction of the cartridge, the at least one first connecting element of the at least one inherently rigid insert has an oversize relative to the at least one second connecting element of the head part.

10. The cartridge according to claim 9, wherein the oversize is less than 1% of a diameter of the at least one non-inherently rigid elongate film pouch.

11. The cartridge according to claim 10, wherein the oversize is less than 0.6% of the diameter of the at least one non-inherently rigid elongate film pouch.

12. The cartridge according to claim 1, wherein a region of the head part having the at least one second connecting element and facing, in the longitudinal direction of the cartridge, a base region of the at least one non-inherently rigid elongate film pouch has, in an unloaded base position, a distance to a shoulder of the at least one inherently rigid insert in the longitudinal direction of the cartridge, such that a movement of the at least one inherently rigid insert relative to the head part in the longitudinal direction of the cartridge is made possible.

13. The cartridge according to claim 1, wherein the at least one inherently rigid insert has a passage closed by the cover.

14. The cartridge according to claim 1, wherein the at least one non-inherently rigid elongate film pouch is formed by a cylindrical film tube which is closed at the bottom by a base part.

15. The cartridge according to claim 1, wherein the head part is designed to connect at least two inherently rigid inserts.

16. The cartridge according to claim 15, wherein the head part connects the at least two inherently rigid inserts, wherein each of the at least two inherently rigid inserts forms a respective passage, and wherein each respective passage is closed by a respective cover attached to the respective inherently rigid insert.

17. The cartridge according to claim 16, wherein each of the at least two inherently rigid inserts defines a respective connection region with the head part.

18. The cartridge according to claim 17, wherein the head part includes a respective connection region corresponding to each of the at least two inherently rigid inserts.

* * * * *